US006229981B1

(12) United States Patent
Kida

(10) Patent No.: US 6,229,981 B1
(45) Date of Patent: May 8, 2001

(54) TONER IMAGE TRANSFER APPARATUS

(75) Inventor: Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/553,473

(22) Filed: Apr. 20, 2000

(30) Foreign Application Priority Data

Apr. 22, 1999 (JP) ..... 11-114329

(51) Int. Cl.[7] ..... G03G 15/14; G03G 21/00
(52) U.S. Cl. ..... 399/313; 399/303; 399/314
(58) Field of Search ..... 399/313, 312, 399/314, 303

(56) References Cited

U.S. PATENT DOCUMENTS 5,485,257 * 1/1996 Ueda et al. ..... 359/272
5,557,383 * 9/1996 Hasegawa et al. ..... 355/271
5,678,149 * 10/1997 Takekoshi et al. ..... 399/299
5,870,649 * 2/1999 Gotoh ..... 399/66

FOREIGN PATENT DOCUMENTS 51-9840 1/1976 (JP) .
56-154773 11/1981 (JP) .

* cited by examiner

*Primary Examiner*—Richard Moses

(57) ABSTRACT

It is an object of the invention to prevent reduction in output speed in the case where toner or the like adhered to a transfer belt is transferred to a side of an image carrying body and cleaning is performed by a cleaning device on a side of the image carrying body. A toner image transfer apparatus is constituted by extending a transfer belt between a first transfer roller, which is brought into pressure contact with a photoreceptor, and a second transfer roller disposed away from the photoreceptor and on a downstream side in a sheet conveying direction, and a circumferential length of the transfer belt is set to be equal to or less than a spacing between sheets conveyed (sheet spacing D) such that, in the sheet spacing D, over which a sheet passes a transfer position and which a subsequent sheet reaches, a cleaning voltage is supplied to shift toner or the like, adhered to the transfer belt, to the photoreceptor to have the same removed by a cleaning device on a side of the photoreceptor. An entire circumference of the transfer belt enables using the sheet spacing D to perform cleaning, thus ensuring a favorable cleaning quality without reduction in output speed.

7 Claims, 4 Drawing Sheets

TONER IMAGE TRANSFER APPARATUS

BACKGROUND OF THE INVENTION

1. Field of the Invention

The invention relates to a toner image transfer apparatus for transferring a toner image formed on an image carrying body, to a recording material such as a sheet, in an image forming apparatus employing an electrophotographic system.

2. Description of the Related Art

In an image forming apparatus such as an image forming apparatus employing an electrophotographic system, a toner image is formed on a photoreceptor as an image carrying body and is transferred to a sheet of plain paper or the like, then the toner of the toner image is fixed on the sheet, for example, by passing the sheet through a heat fixing device, to preserve the toner image on the sheet as a permanent image on the sheet, and lastly the sheet is discharged outside the apparatus.

According to such image forming apparatus, a sheet must be conveyed to a position of image formation in order to form a desired image on the sheet. For example, sheets are received in a paper feed cassette or a tray in large quantity, and a sheet feeding device is provided for feeding sheets one by one from the cassette or the tray to an image forming unit, in particular, a conveying path lead to a transfer position where a toner image formed on a photoreceptor is transferred.

A tip end of a sheet fed through the sheet feeding device is guided to a surface of the photoreceptor in the transfer position. In the transfer position, a transfer apparatus is provided for transfer of a toner image formed on the photoreceptor. The transfer apparatus comprises charging means for charging a back surface of a sheet to be of reverse polarity to the charged polarity of a toner image. The charging means conventionally includes corona dischargers, transfer roller or the like.

The corona dischargers can charge the back surface of a sheet with electricity in non-contact condition, and so do not contaminate the back surface of a sheet. However, problems such as leakage or the like occur due to generation of ozone and supplying of extremely high voltage.

In contrast, in the case where a transfer roller is used, it comes into direct contact with the back surface of a sheet to bring a sheet into pressure contact with a photoreceptor, and so the transfer voltage may be on the order of 1 kV to enable preventing generation of ozone as in corona dischargers, and to decrease problems such as leakage. In the case of transfer rollers, however, toner or the like will not adhere to a transfer roller provided that the roller is brought into pressure contact with the photoreceptor with the sheet therebetween, and when the roller comes into pressure contact with the photoreceptor in a state, in which any sheet is not present, an unnecessary toner remaining on the photoreceptor will adhere to the roller. Therefore, the back surface of a sheet will be contaminated by toner or the like unless the adhered toner is not removed.

Here, in an arrangement, in which a transfer roller or the like is used, a cleaning device is provided for cleaning the surface of the roller. For example, Japanese Unexamined Patent Publication JP-A 51-9840 (1976) proposes means, in place of such cleaning device, in which a transfer voltage for transfer of a toner image is supplied to a transfer roller in a timing that a sheet passes a transfer position, and a cleaning voltage with a polarity reverse to that of the transfer voltage is supplied to the roller in a state, in which a sheet does not pass the transfer position, to shift toner, adhered to the transfer roller, to a side of a photoreceptor for cleaning.

Accordingly, switching control of the transfer voltage and the cleaning voltage causes toner or the like adhered to the transfer roller to be shifted to the side of the photoreceptor, thus making use of a cleaning device on the side of the photoreceptor to perform cleaning, and eliminating the need of any special cleaning device on the transfer roller separately from the cleaning device on the side of the photoreceptor, whereby the apparatus can be made small-sized.

Also, unlike a transfer roller, a transfer conveying belt has been proposed and practiced for conveying a sheet and transferring to the sheet a toner image formed on a photoreceptor. With such transfer conveying belt, a cleaning device or the like is provided for preventing contamination of a sheet due to adherence of toner. For example, Japanese Unexamined Patent Publication JP-A 56-154773 (1981) describes an arrangement, in which a transfer conveying belt is extended to be, charged with reverse polarity to that of a toner image to attract a sheet electrostatically so that the toner image is transferred together with conveying of the sheet.

As described above, with conventional toner image transfer apparatus provided in an image forming apparatus, respective transfer means has advantages and disadvantages, and so are selectively used in accordance with specifications of an associated image forming apparatus.

For example, in the case where a transfer roller is used, it does not offer any problem with respect to transfer of a toner image onto a sheet, but there is the need of providing a peeling-off pawl, which constitutes peeling-off means, placed in contact with a side of a photoreceptor so that a sheet be peeled off the photoreceptor after transfer. To perform peeling-off of a sheet without the provision of such peeling-off pawl, a diameter of the photoreceptor used must be made as small as possible. Therefore, because of the need of rotating the photoreceptor several times (two or more rotations) for the purpose of transferring images contained in a single sheet to the sheet, the number, in which the photoreceptor is shaved off by a cleaning member, is increased, so that it is shortened in life due to film reduction of a photoreceptor layer.

Therefore, when the photoreceptor is made large in diameter, image formation and transfer can be effected with two or less rotations. However, when the photoreceptor is made large in diameter, peeling-off of a sheet problematically remains such that the apparatus cannot be made small-sized due to the need of provision of separate separation mechanism or the like.

Hereupon, a transfer conveying belt is used to attract and convey a sheet, so that, after transfer, the sheet is attracted not by a side of a photoreceptor but by a side of the belt. Therefore, there is no need of providing a separate separation mechanism or the like, and it is possible to cope with high speed processing without being affected by a diameter of the photoreceptor.

In the case of using the transfer conveying belt, however, it is inevitably necessary to provide a cleaning device separate from a cleaning device on the side of the photoreceptor, so that it cannot be desired to further make the image forming apparatus small-sized. Besides, the transfer conveying belt is formed to be exceedingly lengthy, which correspondingly makes the apparatus large.

As described above, a system, in which a transfer roller is brought into contact with a back surface of a sheet to transfer a toner image thereto, has advantages and disadvantages, so that it is not possible to perform high speed processing, make an apparatus small-sized, and suppress an increase in cost. For example, in the case of using a transfer roller system, a cleaning device is dispensed with by causing toner or the like adhered to the transfer roller to be transferred to a photoreceptor, but it is necessary to separately provide a peeling-off mechanism at all means. The use of a transfer belt system can omit a peeling-off mechanism, but the transfer belt is made lengthy, which does not make miniaturization. Further, with an arrangement, in which toner or the like adhered to the transfer belt is transferred to the photoreceptor with a view to cleaning, cleaning takes time, and so the apparatus cannot cope with high speed running.

SUMMARY OF THE INVENTION

In view of the problems described above, the invention has its object to provide a toner image transfer apparatus in a system for contacting with a back surface of a sheet to transfer a toner image thereto, which enables high speed processing and is capable of being made small-sized and suppressing an increase in cost.

In particular, an object of the invention is to enable cleaning of a transfer belt as transfer means without the provision of any separate cleaning device, and high speed processing by making effective use of a spacing between recording materials, that is, a spacing between a recording material which has passed a transfer position and a recording material to be next conveyed to the transfer position.

The invention provides a toner image transfer apparatus comprising a transfer belt for transferring a toner image formed on a surface of an image carrying body to a recording material conveyed to the image carrying body, a length of the transfer belt being set to be equal to or less than a spacing which is produced between the recording material which is passing through the image carrying body and a recording material to be next conveyed to the image carrying body.

According to the invention, by the arrangement as described above, the transfer belt can be cleaned over the entire length of the transfer belt in a time interval from a time when a recording material has passed a transfer position to a time when a subsequent recording material reaches the transfer position, so that a back surface of the subsequent recording material is relieved of contamination. Further, in the case of conveying a recording material, there is produced a spacing between the recording materials, in which spacing the cleaning process can be effected, whereby output processing is not delayed due to cleaning and high speed processing can be achieved. Accordingly, it is possible to make the entire image forming apparatus small-sized.

In the invention it is preferable that the toner image transfer apparatus comprises voltage control means for switchingly supplying to the transfer belt either a transfer voltage, by which a toner image formed on a surface of an image carrying body is transferred to a recording material, or a cleaning voltage, by which cleaning of a transfer belt is effected in a spacing between the recording materials.

According to the invention, the toner image transfer apparatus characterized in the constitution described above is constructed to switchingly supply to the transfer belt a transfer voltage, by which a toner image is transferred to the side of a recording material, and a cleaning voltage, by which cleaning of the transfer belt is effected in a spacing between the recording materials. According to such an arrangement, the transfer voltage is supplied at a time when a recording material passes the transfer position, and the cleaning voltage is supplied after the passage of a recording material and until a subsequent recording material reaches the transfer position, whereby the transfer belt can be cleaned. In this case, toner or the like adhered to the transfer belt is transferred to the side of the image carrying body to be cleaned by a cleaning device on the side of the image carrying body. Accordingly, the transfer belt is surely cleaned over the entire length of the transfer belt to eliminate the fear of contamination on a back surface of a subsequent transferring material.

In the invention it is referable that the cleaning voltage is AC voltage.

According to the invention, in the toner image transfer apparatus characterized in the constitution described above, the cleaning voltage is AC voltage, which is short in cycle. Application of AC voltage, which is relatively short in cycle, as the cleaning voltage enables vibrating toner or the like minutely, whereby toner or the like adhered to the transfer belt can be surely transferred to the side of the image carrying body.

The invention provides a toner image transfer apparatus comprising a transfer belt for transferring a toner image formed on a surface of an image carrying body to a recording material conveyed to the image carrying body, the transfer belt being endless, an entire circumferential length of the transfer belt being set to be equal to or less than a spacing which is produced between the recording material which is passing through the image carrying body and a recording material to be next conveyed to the image carrying body; the transfer belt being extended between a first transfer roller, which is brought into pressure contact with an image carrying body, and a second transfer roller disposed away from the image carrying body and on a downstream side of the first transfer roller, in a recording material conveying direction, the toner image transfer apparatus further comprising voltage control means for switchingly supplying to the first transfer roller, either a transfer voltage, by which a toner image formed on a surface of the image carrying body is transferred to a recording material, or a cleaning voltage, by which cleaning of the transfer belt is effected in a spacing between the recording materials.

According to the invention, in a toner image transfer apparatus characterized in the constitution described above, the transfer belt in a concrete configuration is supplied with the transfer voltage and the cleaning voltage, the transfer belt being formed to be endless, and extended between a first transfer roller, which brings the transfer belt into pressure contact with an image carrying body and to which the transfer voltage is supplied, and a second transfer roller disposed away from the image carrying body and on a downstream side of a recording material, in a recording material conveying direction, and the cleaning voltage in place of the transfer voltage being controlled to be supplied to the first transfer roller to clean the transfer belt in a spacing between the recording materials.

According to the arrangement, transfer of a toner image can be carried out by bringing a transfer material, which is conveyed through the transfer belt, into pressure contact with an image carrying body and supplying the transfer voltage to the first transfer roller with the pressure contact position as a transfer position. And, after the transfer, the transfer material is attracted toward the side of the transfer belt to be separated from the side of the image carrying body to be conveyed. Therefore, there is no need of providing any separation mechanism the side of the image carrying body, which prevents the entire transfer apparatus from becoming large-sized, and enables miniaturization of the apparatus. Besides, it is unnecessary to make a diameter of an image carrying body so as to effect natural peeling-off, so that a range in design is enlarged and a diameter or the like can be optionally set to extend a life of the image carrying body.

In the invention it is preferable that the cleaning voltage is AC voltage.

According to the invention, in the toner image transfer apparatus characterized in the constitution described above, the cleaning voltage is AC voltage, which is short in cycle. Application of AC voltage, which is relatively short in cycle, as the cleaning voltage enables vibrating toner or the like minutely, whereby toner or the like adhered to the transfer belt can be surely transferred to the side of the image carrying body.

The invention provides a toner image transfer apparatus comprising a transfer belt for transferring a toner image formed on a surface of an image carrying body to a recording material conveyed to the image carrying body, an entire circumferential length of the transfer belt being set to be less than a spacing which is produced between the recording material which is passing through the image carrying body and a recording material to be next conveyed to the image carrying body, the toner image transfer apparatus further comprising voltage control means for switchingly supplying to the transfer belt either a transfer voltage, by which a toner image formed on a surface of an image carrying body is transferred to a recording material, or a cleaning voltage, by which cleaning of a transfer belt is effected in a spacing between recording materials and for cleaning at least the transfer belt over the the entire circumference thereof by the provision of durations, during which supplying of the transfer voltage and the cleaning voltage is suspended, before and after the spacing between the recording materials.

According to the invention, in a toner image transfer apparatus characterized in the constitution described above, the transfer belt is set to be less than a spacing between the recording materials as conveyed, and durations, during which the cleaning voltage is suspended, before and after the spacing, are provided so that it is supplied and controlled so as to enable cleaning at least the transfer belt over the entire circumference thereof. According to such an arrangement, it becomes possible to set durations, during which the cleaning voltage is switchingly controlled, before and after the spacing between the recording materials. Therefore, preciseness or the like in switching from the transfer voltage to the cleaning voltage is not required, and so it is possible to accommodate some deviations in timing to ensure favorable transfer and a cleaning quality. More specifically, in the case where there is not for suspension durations in a timing that a state, in which the transfer voltage is supplied, is changed over to the cleaning voltage, errors such as deviations of a transfer material, deviations in timing or the like would cause failure in transfer at a trailing end or a leading end of a recording material due to supplying of the cleaning voltage, and incapability of cleaning the transfer belt precisely over the entire circumference thereof, so that there remains a danger of a back surface of the trailing end or leading end of the recording material being contaminated by that portion of the belt, which cannot be cleaned. However, it is possible according to the invention to solve such disadvantage.

In the invention it is preferable that the cleaning voltage is AC voltage.

According to the invention, in a toner image transfer apparatus characterized in the constitution described above, the cleaning voltage is AC voltages which is short in cycle. Application of AC voltage, which is relatively short in cycle, as the cleaning voltage enables vibrating toner or the like minutely, whereby toner or the like adhered to the transfer belt can be surely transferred to the side of the image carrying body.

According to the toner image transfer apparatus of the invention, since the transfer belt is provided, a toner image is transferred to a recording material such as a sheet through the transfer belt. Therefore, the recording material passes a transfer position where it is attracted by the transfer belt and is simply separated from the image carrying body, which eliminates the need of specifically providing any separation mechanism.

Also, since the circumferential length of the transfer belt is set to be equal to or less than a minimum spacing between recording materials, which are fed suitably, a spacing between the recording material conveyed to the image carrying body and the recording material to be next conveyed thereto, is effectively used to perform the cleaning process, in which toner or the like adhered to the transfer belt is transferred to the side of the image carrying body to be capable of being subjected to cleaning process by a cleaning device provided on the side of the image carrying body. Therefore, there is no need of providing a cleaning device independently on the side of the transfer belt, thus enabling making the entire apparatus small-sized.

Further, as for the cleaning voltage, by which the transfer belt is cleaned, supplying of AC voltage enables surely transferring toner or contaminant, which is adhered to the transfer belt, to the side of the image carrying body to prevent contamination on the transfer belt from contaminating a back surface of a sheet.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
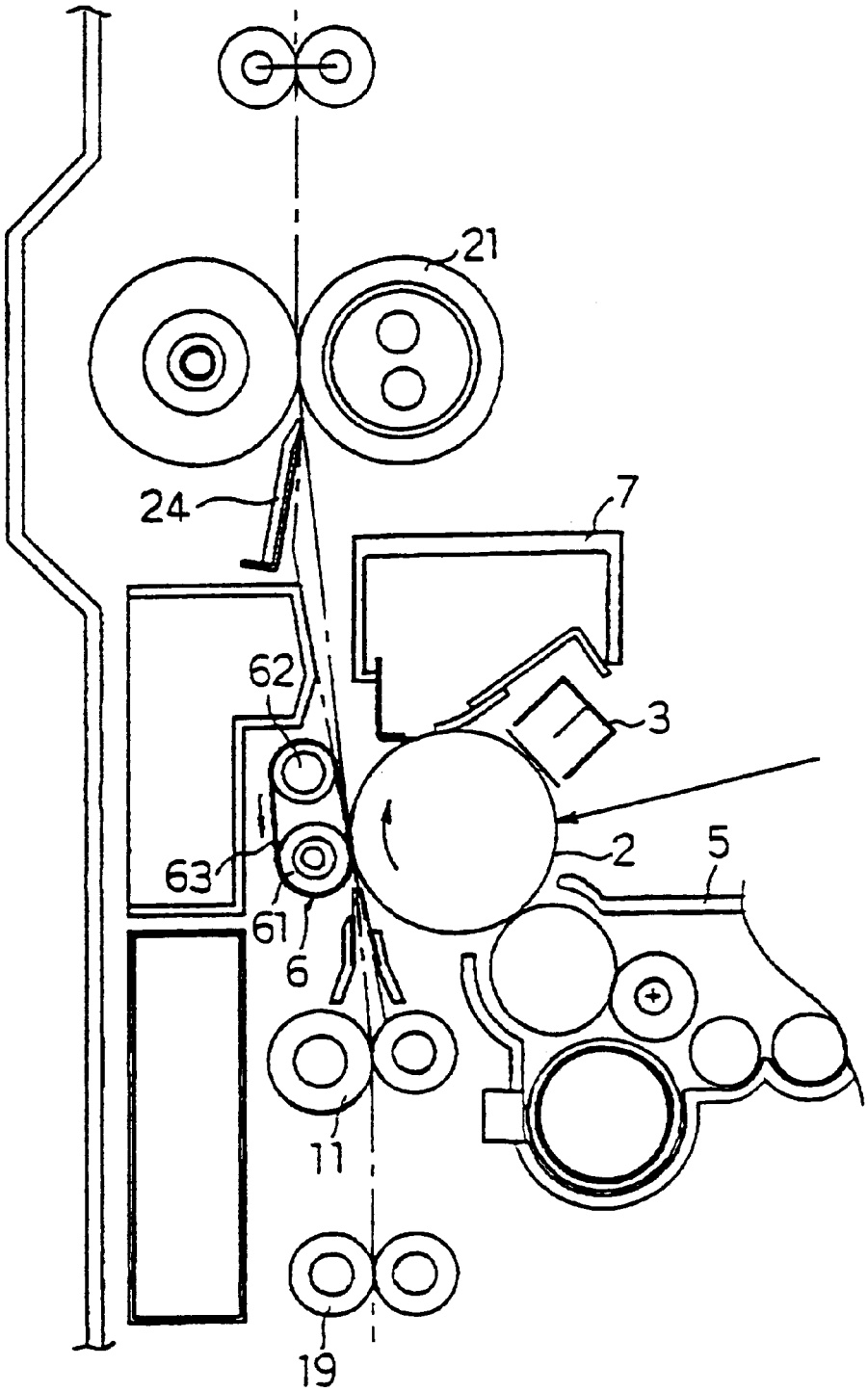
FIG. 1 is a view showing an embodiment of a toner image transfer apparatus according to the invention, and is an enlarged view of an essential part of an image forming unit, which constitutes the apparatus.

Now referring to the drawings, preferred embodiments of the invention are described below.

Figure 2:
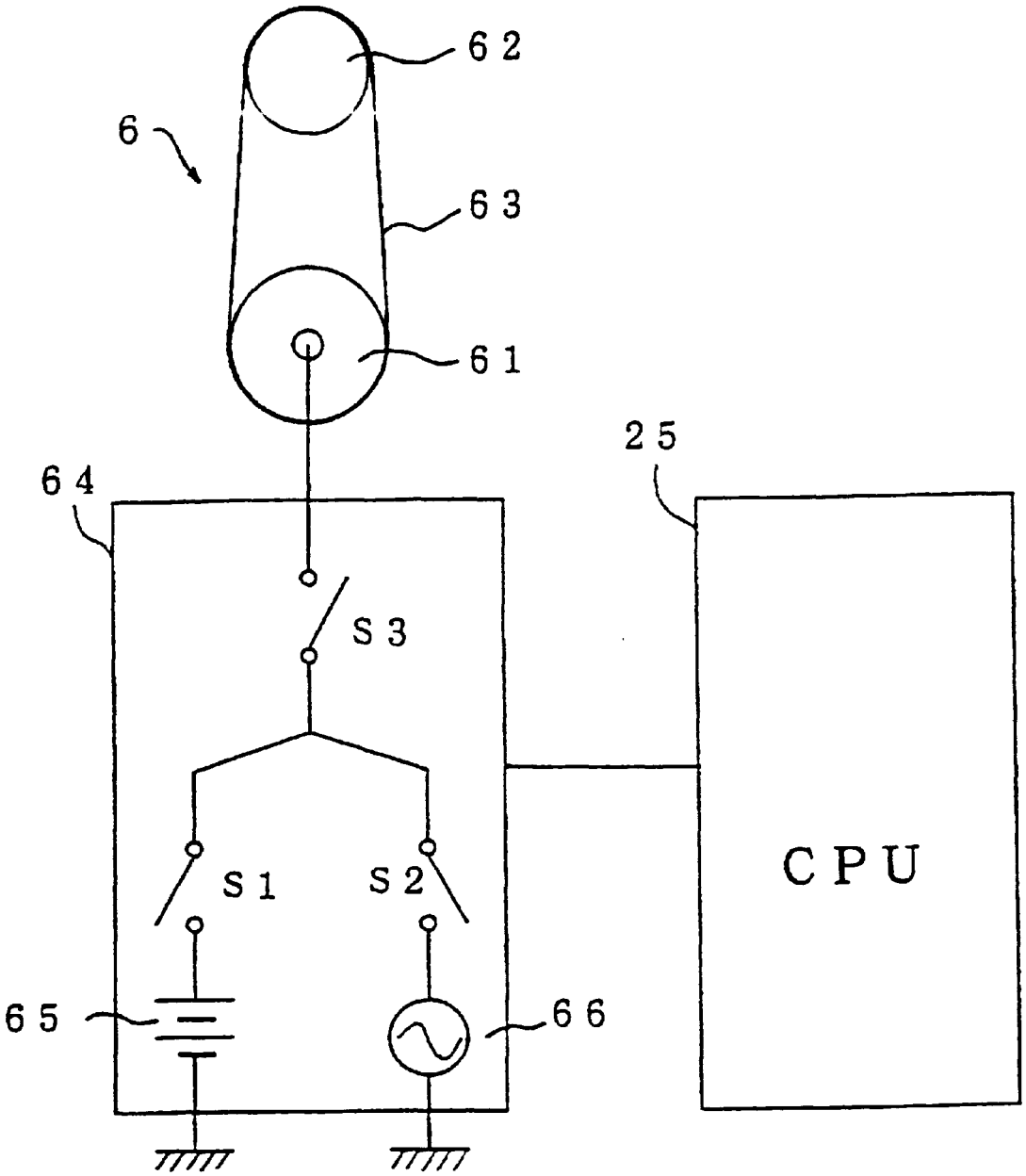
FIG. 2 is a view including a block diagram of a circuit for switching and controlling the transfer voltage and the cleaning voltage in the toner image transfer apparatus of FIG. 1.
Figure 3:
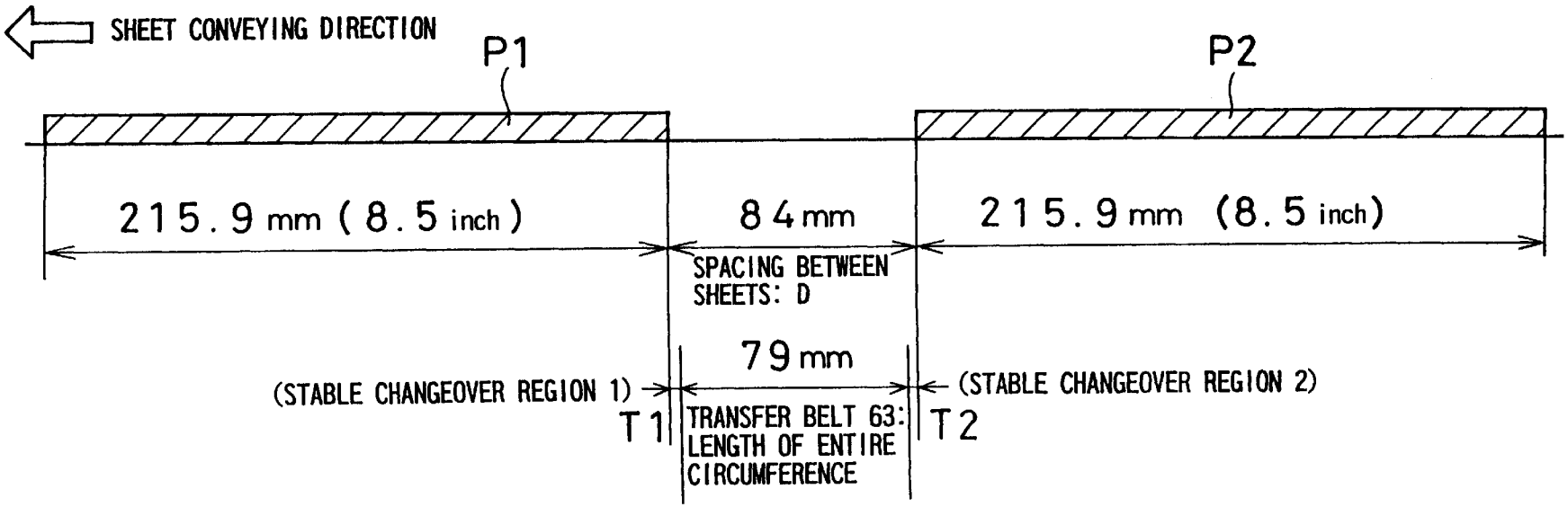
FIG. 3 is a view explaining cleaning control and action of a transfer belt, which constitutes a toner image transfer apparatus according to the invention.
Figure 4:
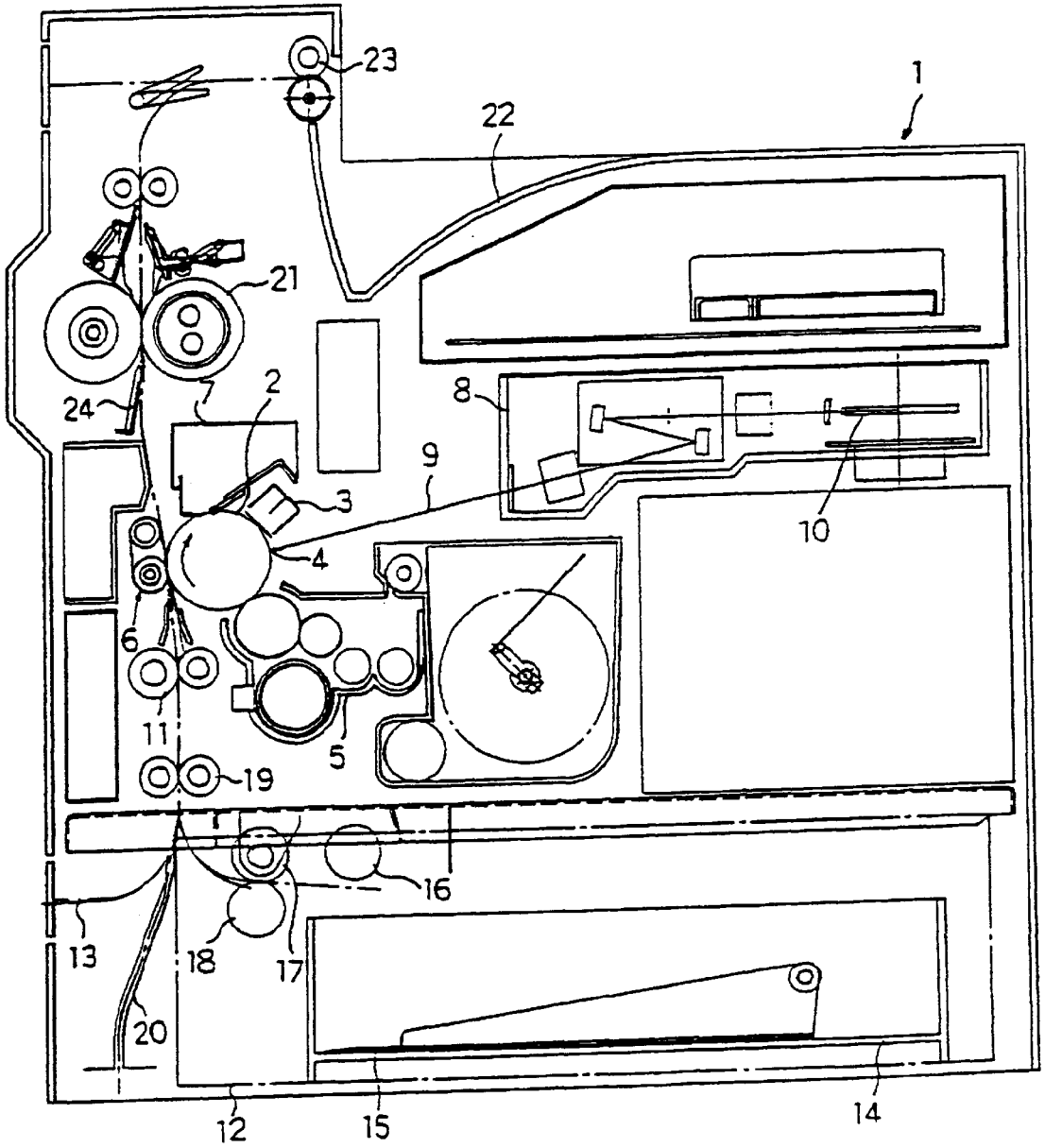
FIG. 4 is a view showing an entire construction of an image forming apparatus provided with the toner image transfer apparatus of FIG. 1.

An embodiment suitable for a toner image transfer apparatus according to the invention will be described hereinbelow in details with reference to the drawings. FIG. 1 is a view showing an image forming unit including a toner image transfer apparatus according to the invention. Also, FIG. 2 is a view including a block diagram of a switching and controlling circuit showing an concrete example of a toner image transfer apparatus for the purpose of explaining an embodiment of the invention. FIG. 3 is a view illustrating a state of passage of a sheet, which is a recording material, and timing control, by which a distance between sheets is made use of to implement the cleaning process, for the purpose of explaining an embodiment of the invention. FIG. 4 is a view showing an entire construction of an image forming apparatus provided with the toner image transfer apparatus of the invention.

Referring to FIG. 4, an image forming apparatus according to the invention will be first described. The image forming apparatus 1 is a laser printer, but the invention can be embodied with the use of digital copying machine, facsimile apparatus using the electrophotographic system or the like, other than such printer.

With the image forming apparatus 1 shown in FIG. 4, arranged in the following order to face a photoreceptor 2 in the form of a drum, being an image carrier, of which surface is adapted to rotate in a direction of an arrow as shown in the figure and is formed with a photoconductive layer, are a charger 3 for charging electricity uniformly on the surface of the photoreceptor along a direction of rotation, an exposure unit 4 for subjecting the charged surface to image exposure, a developing device 5 for developing an electrostatic latent image formed by exposure, a toner image transfer apparatus 6 according to the invention for transferring the developed toner image to a sheet being a recording material, and a cleaning device 7 for removing residue of toner after transfer.

The exposure unit 4 for subjecting the surface of the photoreceptor 2 to image exposure irradiates a laser beam 9 on the surface of the photoreceptor 2 by a laser irradiation device 8. The laser irradiation device 8 drives a semiconductor laser by on-off control in accordance with image data as input to polarize the laser beam 9 with the use of a polygon mirror 10, which serves as a polariscope, and scans the laser beam 9 through various mirrors, lenses and so on in a direction of rotation axis of the photoreceptor 2. Thus the laser beam 9 is irradiated on the surface of the photoreceptor 2, which is uniformly charged with electricity by means of the charger 3, so that an electrostatic latent image is formed in accordance with an image.

The electrostatic latent image formed on the photoreceptor 2 is made a visible image by toner in the developing device 5, and the image having been made visible is transferred to a sheet conveyed via a sheet feeding system of the invention by an action of the toner image transfer apparatus 6 in the invention.

in order that a light image in accordance with image data is irradiated with the laser beam 9 to the photoreceptor 2, a connection device for inputting external data is provided on a body of the image forming apparatus 1 so that the inputted image data is developed (or image processing) into data or the like, which can be processed by the image forming apparatus 1. Also, the image data is transmitted from outside, which data enables image formation in the body of the image forming apparatus 1.

In this case, in the case of the image forming apparatus being a digital copying machine, a scanner which optically reads image on an original is provided. Further, in the case of a facsimile apparatus, the facsimile apparatus is constructed to include devices for demodulating data transmitted through the telephone line from other facsimile apparatus and for converting and processing the data into image data, which can be output by a printer, as well as a scanner.

In the image forming apparatus 1 described above, a conveying system for transferring an image formed on the surface of the photoreceptor 2, that is, a toner image onto a sheet, and finally outputting the image to outside the image forming apparatus 1. The sheet conveying system has a function that a sheet is fed to a target position facing a transfer position on the toner image transfer apparatus 6 in the manner described above, and after transfer separated from the photoreceptor 2 and conveyed and discharged to a discharge tray one by one through a heat fixing device, which tray is provided on an upper portion of the body of the image forming apparatus 1.

Hereupon, a sheet conveying device for feeding a sheet to the transfer position will be described. A sheet feeding system is provided to feed a sheet to a resist roller arranged on this side of the transfer position. The sheet feeding system is provided with a resist roller 11, which functions to feed a sheet in synchronization with rotation of the photoreceptor 2. The resist roller 11 is arranged on this side (upstream side) of the transfer position, and a sheet feeding device for feeding a sheet to the resist roller 11 is provided on further upstream side of the resist roller 11.

The sheet feeding device comprises an automatic feeding device 12 provided in a lower portion of the body of the image forming apparatus 1, that is, on the upstream side of the resist roller 11, and a sheet feed unit 13 exclusive for manual paper feed and provided on a left-hand side of the body of the image forming apparatus 1 in FIG. 4.

The automatic feeding device 12, which constitutes the sheet feeding device, includes a paper feed cassette or tray 14 provided to be capable of being pulled, for example, on this side in the figure and constructed to receive sheets having a predetermined size. Therefore, the automatic feeding device 12 is provided with a mount plate 15, which mounts sheets contained in the cassette. The mount plate 15 is rotatably supported on a side opposite to a position facing a paper feed roller 16, and is adapted to be turned so as to be pushed up by a push-up mechanism (not shown).

The mount plate 15 is such that, when fed by the paper feed roller 16, by enegisation of the push-up mechanism, the topmost sheet is brought into pressure contact with the paper feed roller 16 to be fed from a topmost position due to rotation of the paper feed roller 16. In addition, a feed roller 17 and a separation roller 18, which enable feeding sheets one by one, are provided so as to face the paper feed roller 16. Therefore, only the topmost sheet is fed by the feed roller 17.

In a state, in which sheets are not to be fed, the mount plate 15 is turned to a position shown in the figure by non-actuation of a push-up mechanism (not shown), and the paper feed cassette 14 can be pulled out in this state.

A sheet fed through the feed roller 17 and the separation roller 18 is fed along a guide for feeding a sheet to the above-mentioned resist roller 11 through a conveyor roller 19 disposed on this side (upstream side) the resist roller 11.

Meanwhile, the sheet feed unit 13 exclusive for manual paper feed is constructed to be guided to the conveyor roller 19 along the guide. Although not shown here, a sheet detecting sensor is provided on this side the conveyor roller 19 so that detection by the sensor causes the conveyor roller 19 to be rotatingly driven to feed a sheet, which is inserted from the sheet feed unit 13 exclusive for manual paper feed, to the resist roller 11.

On the other hand, the body of the image forming apparatus 1 is provided at its lowermost portion with the automatic feeding device 12, and can be further provided at its lower portion with the automatic feeding device 12 of such construction. In each of the automatic feeding devices 12, a communication passages 20 is provided to guide to the conveyor roller 19 a sheet, which is fed from the automatic feeding device mounted in the lower portion of the body of the image forming apparatus. Accordingly, a plurality of arrangements of the same construction as described above can be mounted below the automatic feeding device 12 of the image forming apparatus 1 shown in FIG. 4 to enable receiving sheets of different sizes in the respective arrangements. Therefore, it is possible to select and automatically feed sheets of a desired size.

Here, a detecting sensor for detecting a sheet is provided on this side (upstream side) of the resist roller 11 or in a position of the conveyor roller 19 (this side of the conveyor roller 19 described above). When the detecting sensor detects a sheet, the conveyor roller 19 is made to rotate for a predetermined period of time since that time to feed a tip end of the sheet to a pressure contact portion (nip portion) of the resist roller 11. After a tip end of the sheet is aligned at the nip portion, rotation of the conveyor roller 19 is controlled so as to be stopped in a state, in which the sheet is somewhat bent. Therefore, conveying of the sheet caused by the start of rotation of the resist roller 11 is made sure, and skew feeding of the sheet can be eliminated.

The resist roller 11 is normally stopped, and starts driving rotation, when the tip end of the sheet is aligned as mentioned above, in order to begin feeding to the transfer position a sheet standing by in a timing that a tip end of a toner image formed on the photoreceptor 2 coincides with the tip end of the sheet.

In this manner, feeding of sheets, and control of feeding sheets to a transfer position facing the photoreceptor 2 are performed, and a toner image formed on the photoreceptor 2 is transferred on a sheet by the action of the toner image transfer apparatus 6. After such transfer, the sheet is separated from the photoreceptor 2 to be fed to a fixing device 21, which is disposed above the photoreceptor 2 in FIG. 4 and is provided with a heat fixing roller. A system for discharging sheets after transfer will be described hereinbelow.

The fixing device 21 is of a conventionally known construction to be maintained at a temperature, at which fixing is enabled, with the heat fixing roller on a roller side facing a toner image carried on a sheet. The heat fixing roller (heat roller) and a pressure roller for bringing a sheet into pressure contact with the heat fixing roller constitute the fixing device 21. In the fixing device 21, a sheet is separated from the photoreceptor 2 after transfer, as described above, to be conveyed along a conveying direction of the toner image transfer apparatus 6 and guided through a guide 24 for guiding a back surface (surface, to which a toner image is not transferred) of a sheet.

A toner image carried on a sheet having passed through the fixing device 21 is made to fuse and undergo fixing. Finally, the sheet is guided along a discharge path through a discharge roller 23 disposed at a discharge port and is discharged onto a discharge tray 22 for discharging process, which tray 22 is disposed outside the image forming apparatus 1. By a sheet detecting sensor disposed between the fixing device 21 and the discharge roller 23 in association with the guide path, detection of a sheet to be discharged is performed. Such detection of a sheet leads to detection of jamming, control of a timing for the start of subsequent image formation or the like.

In connection with the image forming apparatus 1 provided with the sheet feeding device as described above, the toner image transfer apparatus 6 according to the invention will be described in details with reference to FIGS. 1 and 2.

FIG. 1 is an enlarged view showing a sheet conveying system, in particular, an essential part thereof in the transfer position. In FIG. 1, the toner image transfer apparatus 6 comprises a first transfer roller 61, which functions to bring a sheet, which is fed through the resist roller 11, into pressure contact with the photoreceptor 2, a second transfer roller 62 disposed in a position downstream of the first transfer roller 61 in the sheet conveying direction and spaced from the photoreceptor 2, and having a smaller diameter than that of the first transfer roller 61, and a transfer belt 63 provided to extend between the first transfer roller 61 and the second transfer roller 62. The transfer belt 63 is formed to be endless.

The first transfer roller 61 is provided to bring the transfer belt 63 into pressure contact with the drum-shaped photoreceptor 2, and so pushes a sheet against the photoreceptor 2. The first transfer roller 61 is always brought into pressure contact with the photoreceptor 2, and is constructed to be separated therefrom by a separation mechanism (not shown) at the time of exchange of the photoreceptor 2 and so on. The first transfer roller 61 is constructed to be supplied with a transfer voltage of a polarity opposite to the charge polarity of toner for transfer of a toner image formed on the photoreceptor 2.

The entire circumferential length of the transfer belt 63 according to the invention is set to be equal to or smaller than a spacing D between a rear end of a leading sheet and a tip end of a trailing sheet. In the case where the sheet spacing D is set to, for example, about 80 mm, the circumferential length of the transfer belt 63 is set to 80 mm or shorter. Therefore, diameters of the first transfer roller 61 and the second transfer roller 62, over which the transfer belt 63 is extended, as well as a spacing between the rollers 61, 62 are suitably set.

Further, while the first transfer roller 61 according to the present invention is supplied with a transfer voltage for transferring a toner image onto a sheet as described above, it is controlled to be separately supplied with a cleaning voltage, for example, AC voltage, for cleaning of the transfer belt 63. More specifically, the first transfer roller 61 is supplied with the cleaning voltage to be controlled in a sheet interval, during which a subsequent sheet reaches the transfer position after a preceding sheet passes the transfer position.

FIG. 2 shows a constitution of a circuit for the above arrangement. In FIG. 2, the first transfer roller 61 is connected via a rotating shaft to an electric source voltage switching circuit 64, which is provided with changeover switches S1, S2 to supply and control a transfer voltage or the cleaning voltage. The electric source voltage switching circuit 64 comprises a high positive voltage source 65 in the case of a direct current, for example, a negative-charged toner being used as the transfer voltage, and an AC source 66 for the cleaning voltage, and switches and controls such sources by the changeover switches S1, S2. In addition, the switch S3 is an electric source switch, which functions to prevent voltage from being supplied to the first transfer roller 61 in the stand-by state of the image forming apparatus.

The electric source voltage switching circuit 64 is connected to a control circuit (CPU) 25 for controlling the entire image forming apparatus 1 such that switching control of the switches S1, S2 is performed in accordance with an action of image formation.

In the above arrangement, when a command for the start of image formation is issued, the automatic feeding device 12 or the like is selected in accordance with control of the control circuit 25, and a sheet in position is fed by the paper feed roller 16 to be fed to the resist roller 11 through the conveyor roller 19. With the start of image formation, the photoreceptor 2 is rotated and driven, and the surface of the photoreceptor 2 is uniformly charged with electricity. When processing of the inputted image data or the like is completed to enable writing the image data, action of the laser irradiation device 8 starts to cause the laser beam 9 to irradiate a light image in accordance with the image data on the exposure unit 4.

Accordingly, an electrostatic latent image corresponding to the image data is formed on the photoreceptor 2 and is made a visible image by the developing device 5. To begin conveying a sheet, which has been beforehand fed to the resist roller 11 to stand by, in a timing that a tip end of a toner image formed on the photoreceptor 2 coincides with the tip end of the sheet, the resist roller 11 is controlled in starting driving.

When driving of the resist roller 11 is started, the sheet is fed to a position where the photoreceptor 2 and the toner image transfer apparatus 6 are brought into pressure contact with each other, through the guide. In the toner image transfer apparatus 6, the sheet is brought into pressure contact with the photoreceptor 2, so that a toner image on the photoreceptor 2 is transferred thereto. At this time, the control circuit 25 outputs a drive control signal to the first transfer roller 61, which constitutes the toner image transfer apparatus 6, and the switches S3 and S1 of the electric source voltage switching circuit 64 are made on to have the DC source 65 supplying a transfer voltage.

Accordingly, the sheet is brought into pressure contact with the photoreceptor 2 through the transfer belt 63, and simultaneously the transfer voltage acts from a back surface side of the sheet to transfer a toner image formed on the photoreceptor 2 to a sheet side. The sheet after the transfer is not attracted to the side the photoreceptor 2, is made by the attracting action on the transfer belt 63 to pass the transfer position, then is separated from the photoreceptor 2, and is guided to the fixing device 21 through the guide 24 along the conveying direction of the transfer belt 63 as it is.

The transfer voltage is supplied with the first transfer roller 61, whereby the transfer belt 63 functions to electrostatically attract the sheet, and separate the sheet from the photoreceptor 2 in the attracted condition to convey the same. Therefore, it is unnecessary to provide any separating mechanism on the side of the photoreceptor 2, and the photoreceptor 2 is made in diameter as small as possible to be made large in curvature so that flexibility and stiffness of the sheet are used to eliminate the need of relying on natural peeling-off. Accordingly, the photoreceptor 2 can be set to an optional diameter to cope with high speed and extend in life, thus widening a range of design.

Further, when the transfer belt 63 conveys the sheet to a position of the second transfer roller 62 with the sheet attracted thereto, it is reversed. Therefore, the sheet is separated from the transfer belt 63 due to a great curvature caused by such reversing, and is fed to the fixing device 21.

In this manner, when a toner image is transferred to the first sheet and a trailing end of the sheet is sensed by the sheet detection sensor provided in a position of the conveyor roller 21 or the resist roller 11, the automatic feeding device 12 begins paper feeding so as to feed a subsequent sheet. The subsequent sheet is also made to have its tip end aligned in a position of the resist roller 11 to stand by temporarily.

Thus, a specified sheet spacing D is produced between sheets although affected by a sheet size used and a conveying speed (output speed). The sheet spacing D is determined by a length of the conveying path, an arrangement of the sheet detection sensor, and other factors, and so is inevitably produced.

To make use of the sheet spacing D to perform cleaning of toner or the like adhered to the transfer belt 63 on the toner image transfer apparatus 6, a cleaning voltage is supplied in place of the transfer voltage fed to the first transfer roller 61. More specifically, at a time when a trailing end of a preceding sheet passes the transfer position, in particular, a position where the photoreceptor 2 and the transfer belt 63 are brought into pressure contact with each other, and until a tip end of a subsequent sheet reaches the transfer position (pressure contact position), a cleaning voltage is supplied with the switch S2 made on. At this time, the switch S1 is made off to stop supply of the transfer voltage. In addition, the switch S3 remains on.

Accordingly, since the transfer belt 63 are brought into direct pressure contact with the photoreceptor 2 and the cleaning voltage is supplied, toner or the like adhered to the transfer belt 63 is transferred to the photoreceptor 2 side. Toner or the like transferred to the photoreceptor 2 side is removed together with a residual the toner, which remains on the preceding toner image, by the cleaning device 7. Accordingly, foreign matters such as toner adhered to the transfer belt 63 are efficiently removed with the use of the sheet spacing D.

Also, the cleaning device 7, which cleans the surface of the photoreceptor 2, can be used in combination in the cleaning process without the provision of a separate cleaning device for directly cleaning the transfer belt 63. Besides, since the sheet spacing is used to carry out the cleaning process, the output processing can be carried out without changing the sheet feeding speed and the sheet spacing at all and without reduction in reproduction output speed for image formation at all.

Besides, since the length of the transfer belt 63 is set to the sheet spacing D or less, the entire circumference of the belt can be subjected to cleaning process to eliminate the fear of a back surface of a sheet being contaminated by toner. In this case, the fear of a back surface of a sheet being contaminated is eliminated wholly since the entire circumference of the transfer belt 63 can be cleaned until a subsequent sheet is fed to the transfer position.

For example, in the case where sheets P1, P2 having a letter size are fed as shown in FIG. 3 with the sheet spacing D being at least 84 mm, the circumferential length of the transfer belt 63 is set to 79 mm. At a time when the transfer belt 63 is driven to cause a trailing end of the preceding sheet P1 to pass the transfer position (pressure contact position), the transfer voltage is changed over to the cleaning voltage. At this time, the transfer voltage is made off (the switch S1 off) for a predetermined duration T1, and after the lapse of such duration the cleaning voltage is made on (the switch S2 on).

Before a leading end of the subsequent sheet P2 reaches the transfer position and when the cleaning process on the entire circumferential of the transfer belt 63 is completed, the cleaning voltage is made off to be continued in this state for a predetermined duration T2, and the transfer voltage is controlled to be placed in on condition in a timing that the leading end of the subsequent sheet P2 reaches the transfer position. Such control is carried out by a control signal from the control circuit 25, and the control circuit 25 receives a leading end detection signal or a trailing end detection signal from the sheet detection sensor to implement on-off control for changover between the transfer voltage and the cleaning voltage.

Thus, the entire circumference of the transfer belt 63 is cleaned as shown in FIG. 3, and stable changeover regions 1, 2 are provided before and after the sheet spacing D. In the durations T1, T2 corresponding to the regions 1, 2, a control is made to set a suspension condition, in which the transfer voltage and the cleaning voltage are not supplied. In this case, it is possible to set the duration T1=T2.

In addition, an explanation has been given to the effect that control is made upon receipt of a sheet detection signal in order to control switching of the transfer voltage and the cleaning voltage. This is well known, and a period of time, during which a sheet reaches the transfer position (position, where the image transfer apparatus 6 and the photoreceptor 2 are brought into pressure contact with each other) from a position of the resist roller 11 when a sheet standing by in the position of the resist roller 11 is conveyed, is constant, so that a timing of a sheet leading end reaching the transfer position can be correctly grasped by counting a period of time since a time of the start. Also, as for the passage of a sheet trailing end, a position of the sheet trailing end is determined depending upon a size of a sheet conveyed at a time when a sheet leading end is detected during the discharge of the sheet. Therefore, a size of a sheet conveyed is beforehand recognized, and a period of time lapsed from detection of a sheet leading end to the completion of a sheet trailng end passing the transfer position is constant depending upon a size of a sheet, and so the passage through the transfer position can be correctly grasped by counting the period of time.

As describe above, the image transfer apparatus 6 according to the invention is set in size to be equal to or shorter than the sheet spacing D in order to implement the cleaning process on the entire circumferential of the transfer belt 63 with the use of the sheet spacing D, which is produced in image formation. The sheet spacing D is not limited to an example of FIG. 3, but may be set depending upon a sheet spacing D caused in respective image forming apparatus. Also, in the case where a sheet spacing is different due to a difference in size, the entire circumferential length of a transfer belt 63 may be set depending upon a minimum sheet spacing D.

Also, with the running drive of the transfer belt 63, in particular, the second transfer roller 62 is a drive roller. The first transfer roller 61 is supported rotatably about an axis of the drive roller so as to come away from or into pressure contact with the photoreceptor 2.

EXAMPLE

An example will be described hereinbelow in actual motion in order to confirm an effect caused by the constitution of the invention.

In FIG. 1 or the like, a drum-shaped photoreceptor 2 provided in an image forming apparatus 1 is set to have a diameter of 40 mm, a processing speed (output speed for image formation) of 175 mm/sec, and the entire circumferential length of a transfer belt 63 of 79 mm as shown in FIG. 3. In addition, the transfer belt 63 is formed from chloroprene (foamed body of an electrically conductive rubber), and a resistance value thereof is set to around $10^{11}$ to $10^{12}$ $\Omega\cdot cm^3$. Here, in the case where the resistance value of the transfer belt is too small, a transfer voltage would cause a current to flow to the photoreceptor 2 side through the transfer belt, thereby giving a damage to the photoreceptor 2.

Further, in the case of the use of a negative-charged toner, the transfer voltage from a DC source 65 is, for example, +2 kV, and supplies through a rotating shaft of a first transfer roller 61. Also, a second transfer roller 62 is connected to the ground potential. In contrast, a cleaning voltage from a AC source 66 is set to 1.0 to 1.5 kV, and its frequency is set to 1 kHz. These are switchingly controlled by changeover switches S1, S2.

Under the above set condition, a spacing D of a sheet P is 84 mm when sheets of letter size are used. As a result, in relation to the processing speed describe above, an output speed for image formation is 35 sheets per minute in letter size. Also, the sheet spacing (distance between sheets) D is exemplified in the case of the sheet spacing D being minimum while varying depending upon sheet size used, or the like.

Thus, the sheet spacing D in the case of continuous image formation is 84 mm as described above, and is used to permit switching control from the transfer voltage into the cleaning voltage on the first transfer roller 62, and switching control from the cleaning voltage into the transfer voltage thereon at a time when the transfer belt 63 rotates once and the entire circumferential surface thereof is cleaned. As a result, with the sheet spacing D, the cleaning process can be performed on the entire circumferential surface of the transfer belt 63. Therefore, the cleaning voltage being an AC voltage is supplied to cause toner or foreign matters accidentally adhered to the transfer belt 63 to be transferred to the surface of the photoreceptor 2, so that the entire surface of the transfer belt 63 is made clean. In addition, toner or foreign matters transferred to the photoreceptor 2 is removed by the cleaning device 7.

The cleaning voltage having a frequency of 1 kHz can vary between positive polarity and negative polarity at high speed, so that toner or the like on the surface of the photoreceptor 2 is prevented from being transferred to the side of the transfer belt 63, and toner or foreign matters adhered to the transfer belt 63 is surely transferred to the side of the photoreceptor 2.

Further, since the circumferential length (79 mm) of the transfer belt 63 is set less than the spacing D (84 mm) of the sheet P with margin as shown in FIG. 3, suspension durations T1, T2, during which the cleaning voltage supplied to the first transfer roller 61 is suspended, can be provided before and after the sheet spacing D to eliminate deviation in switching timing between the transfer voltage and the cleaning voltage, in conveying of sheets, or the like, and failure of transfer, switching errors or the like, thereby enabling ensuring stable transfer and a cleaning performance.

In the case where it is possible to correctly perform switching timing and to correctly control the timing that leading (position of a trailing end of a sheet P) and trailing (position of a leading end of the sheet P) ends of the spacing D of a sheet P reach the transfer position, transfer and cleaning performances can be ensured without any problem even if the circumferential length of the transfer belt 63 is equal to the sheet spacing D. However, if deviation occurs, a back surface at leading and trailing ends of a sheet is sometimes contaminated, and a back surface of a subsequent sheet is sometimes contaminated with toner adhered to the transfer belt 63.

However, failure in transfer can be eliminated and cleaning can be surely performed on the entire circumference of the transfer belt 63 by providing the suspension durations T1, T2 before and after the sheet spacing D taking account of possible errors or the like. More specifically, even if timing is somewhat deviated, deviation in timing or the like can be absorbed within the above suspension durations T1, T2 to provide for controlling without any problem. In like manner, the transfer voltage can be placed in non-supplying condition in these durations, and so it is possible to ensure transfer and cleaning performances without any problem even if such timing deviates in the duration T1 or T2.

As described above, the sheet spacing D produced at the time of sheet feeding in the image forming apparatus 1 is used to make the entire circumferential length of the transfer belt 63 equal to or preferably less than the sheet spacing D, whereby the entire circumference of the transfer belt 63 can be efficiently cleaned to eliminate contamination of a sheet back surface caused by toner or the like. Also, even if the transfer belt 63 is brought into contact with the photoreceptor 2 at all times, the surface of the sheet spacing D can be cleaned by supplying of the cleaning voltage, so that the arrangement is made much simple in construction without the need of providing a structure in a manner to make the same toward and away from a sheet in a timing of sheet conveying and controlling the same.

Further, since the cleaning process can be implemented using the sheet spacing D, reduction in output speed for image formation is avoided. Therefore, a high speed processing of high output speed can be achieved, and the need of providing any separate cleaning device is eliminated, so that the apparatus is prevented from becoming large-sized.

While AC voltage is selected as the cleaning voltage in describing the above embodiments, a cleaning voltage with the same charge polarity as that of toner, for example, a negative DC may be selected for a negative-charged toner. Besides, DC voltage and AC voltage may be, off course, superposed on one another to be supplied to the first transfer roller 61. Further, a value of voltage and polarity supplied may be suitably set to toner which is appropriately used, properties of a photoreceptor, and so on, and so are not limited the numerical values described above.

Additionally, in the case where the circumferential length of the transfer belt 63 is made less than the sheet spacing D, it nees not be set a length, which enables cleaning of two runs of the transfer belt 63. Therefore, assuming that at least the circumferential length of the transfer belt 63 is L, it is preferable to set a range represented by $D \leqq L < D/2$ in relation to the sheet spacing D. More specifically, if the circumferential length L of the transfer belt 63 is less than D/2, the first and second transfer rollers must be small and a spacing therebetween must be small, which presumably makes design or the like difficult and increases a manufacturing cost or the like. Also, there is a fear of failures in transfer, conveying and so on. However, provided that problems in manufacture or the like are solved, and failures in transfer, conveying and so on can be solved, cleaning of the surface of the transfer belt 63 can be performed several times during the passage of the sheet spacing D to improve the cleaning effect.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner image transfer apparatus comprising:

a transfer belt for transferring a toner image formed on a surface of an image carrying body to a recording material taken to the image carrying body, an entire length of the transfer belt being set to be equal to or less than a spacing which is produced between the recording material which is passing through the image carrying body and a recording material to be next conveyed to the image carrying body.

2. The toner image transfer apparatus of claim 1, further comprising:

voltage control means for switchingly supplying to the transfer belt either a transfer voltage, by which a toner image formed on a surface of an image carrying body is transferred to a recording material, or a cleaning voltage, by which cleaning of a transfer belt is effected in the spacing between the recording materials.

3. The toner image transfer apparatus of claim 2, wherein the cleaning voltage is AC voltage.

4. A toner image transfer apparatus comprising:

a transfer belt for transferring a toner image formed on a surface of an image carrying body to a recording material conveyed to the image carrying body, the transfer belt being endless, an entire circumferential length of the transfer belt being set to be equal to or less than a spacing which is produced between the recording material which is passing through the image carrying body and a recording material to be next conveyed to the image carrying body, the transfer belt being extended between a first transfer roller, which is brought into pressure contact with an image carrying body, and a second transfer roller disposed away from the image carrying body and on a downstream side of the first transfer roller, in a recording material conveying direction, the toner image transfer apparatus further comprising:

voltage control means for switchingly supplying to the first transfer roller, either a transfer voltage, by which a toner image formed on a surface of the image carrying body is transferred to a recording material, or a cleaning voltage, by which cleaning of the transfer belt is effected in the spacing between the recording materials.

5. The toner image transfer apparatus of claim 4, wherein the cleaning voltage is AC voltage.

6. A toner image transfer apparatus comprising:

a transfer belt for transferring a toner image formed on a surface of an image carrying body to a recording material conveyed to the image carrying body, an entire circumferential length of the transfer belt being set to be less than a spacing which is produced between the recording material which is passing through the image carrying body and a recording material to be next conveyed to the image carrying body, the toner image transfer apparatus further comprising:

voltage control means for switchingly supplying to the transfer belt either a transfer voltage, by which a toner image formed on a surface of an image carrying body is transferred to a recording material, or a cleaning voltage, by which cleaning of a transfer belt is effected in the spacing between the recording materials and for cleaning at least the entire circumference of the transfer belt by the provision of durations, during which supplying of the transfer voltage and the cleaning voltage is suspended, before and after the spacing between the recording materials.

7. The toner image transfer apparatus of claim 6, wherein the cleaning voltage is AC voltage.

* * * * *